US008782839B1

(12) United States Patent
Forbis et al.

(10) Patent No.: US 8,782,839 B1
(45) Date of Patent: Jul. 22, 2014

(54) NESTABLE RAMPS

(71) Applicant: Hopkins Manufacturing Corporation, Emporia, KS (US)

(72) Inventors: Charlie L. Forbis, Quapaw, OK (US); Grant Kernan, Monkey Island, OK (US)

(73) Assignee: Hopkins Manufacturing Corporation, Emporia, KS (US)

( * ) Notice: Subject to any disclaimer, the term of this patent is extended or adjusted under 35 U.S.C. 154(b) by 46 days.

(21) Appl. No.: 13/657,554

(22) Filed: Oct. 22, 2012

(51) Int. Cl.
*E01D 1/00* (2006.01)
*E02C 3/00* (2006.01)

(52) U.S. Cl.
USPC ..... 14/69.5; 254/88

(58) Field of Classification Search
CPC ..... B65G 69/30; B65G 69/28; A61G 3/061; A61G 3/06; B66F 7/243; E04F 11/002; E04F 11/00; B63B 27/14; B63B 27/143; B60T 3/00
USPC ..... 14/69.5, 71.1; 404/35, 36, 25, 26; 188/4 R, 5, 32, 36; 414/537; D34/32; 254/88, 50; 410/30; 293/7; 114/101, 114/381
See application file for complete search history.

(56) References Cited

U.S. PATENT DOCUMENTS

| | | | | |
|---|---|---|---|---|
| 2,304,305 | A | 12/1942 | Fulton | |
| 3,819,138 | A | 6/1974 | Rehkopf et al. | |
| 4,103,870 | A * | 8/1978 | Murakami | 254/88 |
| 5,033,146 | A | 7/1991 | Fogarty et al. | |
| RE34,889 | E | 4/1995 | Fogarty et al. | |
| 5,483,715 | A | 1/1996 | Fogarty et al. | |
| 5,894,618 | A * | 4/1999 | Jacobsen et al. | 14/69.5 |
| D493,408 | S | 7/2004 | Chrisco et al. | |
| D502,139 | S | 2/2005 | Chrisco et al. | |
| D511,734 | S * | 11/2005 | Moore et al. | D12/217 |
| 7,000,740 | B2 | 2/2006 | Chrisco et al. | |
| 7,003,836 | B2 * | 2/2006 | Berg | 14/69.5 |
| 7,040,461 | B2 | 5/2006 | Chrisco et al. | |
| D523,609 | S * | 6/2006 | Toal | D34/32 |
| 7,104,524 | B1 * | 9/2006 | Hidding et al. | 254/88 |
| D567,471 | S | 4/2008 | Haimoff | |
| 7,416,166 | B1 * | 8/2008 | Shaw | 254/88 |
| D608,520 | S | 1/2010 | Fick et al. | |
| 7,854,032 | B2 * | 12/2010 | Igwemezie et al. | 14/69.5 |
| 8,251,350 | B2 * | 8/2012 | Fick et al. | 254/88 |
| 2005/0077121 | A1 * | 4/2005 | Chrisco et al. | 188/32 |
| 2006/0016645 | A1 * | 1/2006 | Chrisco et al. | 188/32 |
| 2008/0201873 | A1 * | 8/2008 | Haimoff | 14/69.5 |
| 2010/0252788 | A1 * | 10/2010 | Wickwire | 254/88 |

* cited by examiner

*Primary Examiner* — Abigail A Risic
(74) *Attorney, Agent, or Firm* — Hovey Williams LLP

(57) ABSTRACT

A vehicle ramp supports a wheel in an elevated position spaced above the ground. The vehicle ramp includes an elongated body and an upright column. The upright column is substantially surrounded by the body. The column presents respective parts of the upper surface of the vehicle ramp and extends downwardly therefrom. The column is defined along the upper surface by a groove that intersects the upper surface and extends endlessly about the column so that the column is isolated from the body along the upper surface.

31 Claims, 12 Drawing Sheets

44
24
24
64
128
128
78
60
20
74
100
32
40a
98a
102b
106
20
122
124
26
98b
102b
62
76
106
125
40a
30
22
68
98a
22
34
86
100
80
133
94
136
28
132
133
92
98b
106
7.
7.
88
82
90
100
38
84
20
40a
56
102b
36
98a
46

20
48a
38
102a
34
40a
134
20
40a
56
20
28
126
96b
88
133
124
102b
124
88
98b
94
126
96b
92
48a
134
22
102a
40a
22

NESTABLE RAMPS

BACKGROUND

1. Field

The present invention relates generally to vehicular ramps. More specifically, embodiments of the present invention concern ramps that are nestable.

2. Discussion of Prior Art

Ramps and lifts have long been used to elevate automobiles and other types of vehicles above a ground or floor surface. Prior art vehicle ramps present various shapes and sizes. Conventional ramps are generally designed and constructed to receive and support largely vertical loads associated with the weight of a vehicle. It is also known in the art to have ramp-type structures that are nestable with one another for easy shipping, transportation, and storage. However, prior art vehicle ramps suffer from various undesirable limitations.

SUMMARY

Embodiments of the present invention provide a vehicle ramp that does not suffer from the problems and limitations set forth above.

A first embodiment of the present invention includes a vehicle ramp to engage and support a wheel in an elevated position spaced above the ground. The vehicle ramp broadly includes an elongated body and an upright column. The elongated body forms at least part of a platform section to support the wheel in the elevated position and at least part of an inclined ramp section to permit the wheel to be rolled between the elevated position and a position on the ground. The platform and inclined ramp sections cooperatively present a ground-engaging lower surface and a wheel-supporting upper surface. The upright column is substantially surrounded by the body. The column presents respective parts of the upper surface and extends downwardly therefrom. The column is defined along the upper surface by a surrounding groove that intersects the upper surface and extends endlessly about the column so that the column is isolated from the body along the upper surface.

A second embodiment of the present invention includes a pair of nestable vehicle ramps to support a wheel in an elevated position spaced above the ground. Each of the nestable vehicle ramps broadly includes a body and an upright column. The body is operable to support the wheel in the elevated position and to permit the wheel to be rolled between the elevated position and a position on the ground. The body includes upright side walls and an upper wall that interconnects and extends between the side walls. The upper wall presents a wheel-supporting upper surface that defines an upper surface area. The body defines an inner chamber between the walls and an open face communicating with the inner chamber. The open face defines a face area that is greater than the upper surface area so that the upper surface of one of the vehicle ramps can be received through the open face and at least partly within the inner chamber of the other of the vehicle ramps. The upright column is substantially surrounded by the body. The column presents part of the upper surface and projects downwardly from the upper surface to define a hollow center spaced below the upper surface, with the column of one ramp received in the hollow center of the other ramp when the one ramp is received through the open face of the other ramp. The column is defined along the upper surface by a groove that intersects the upper surface and extends endlessly about the column so that the column is isolated from the body along the upper surface.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein:

FIG. 3 is a bottom view of the vehicle ramp shown in FIGS. 1 and 2;

Figure 9:
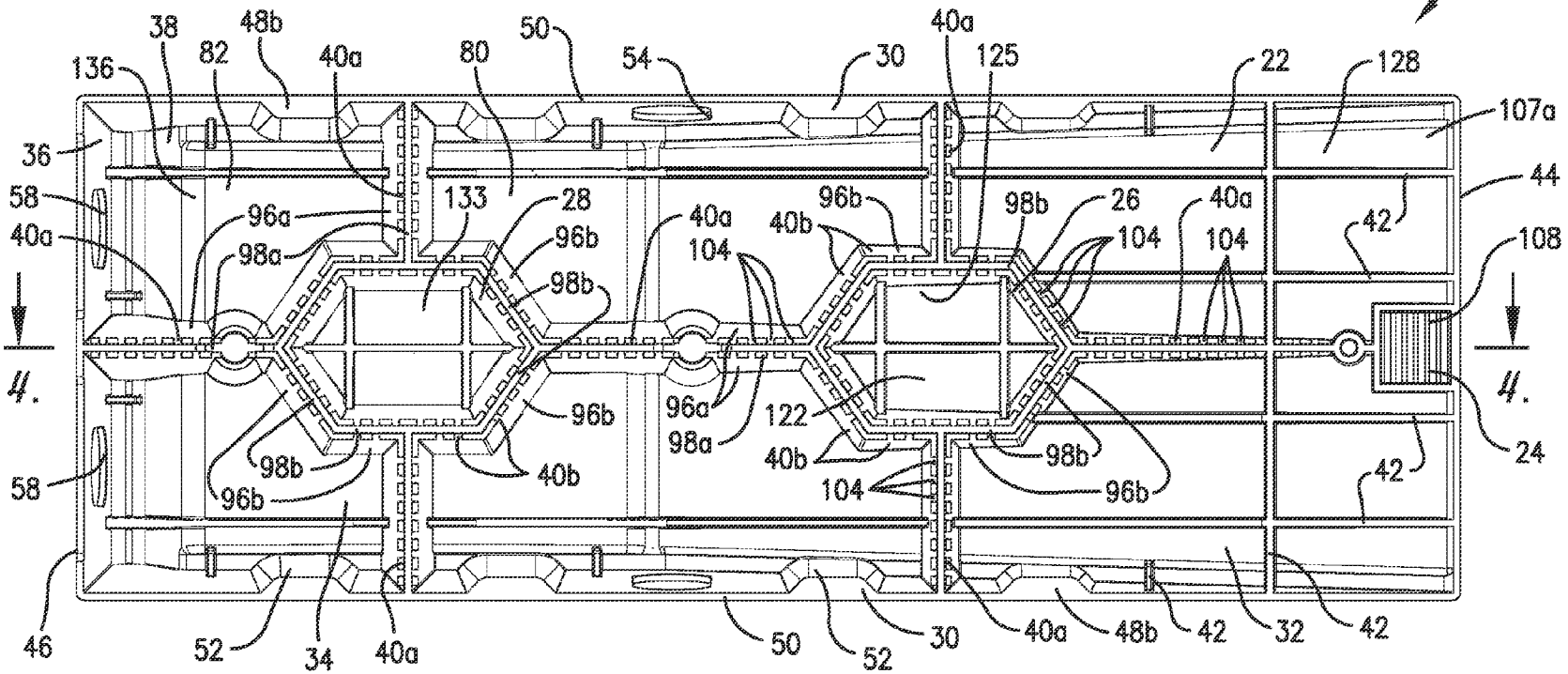
Figure 4:
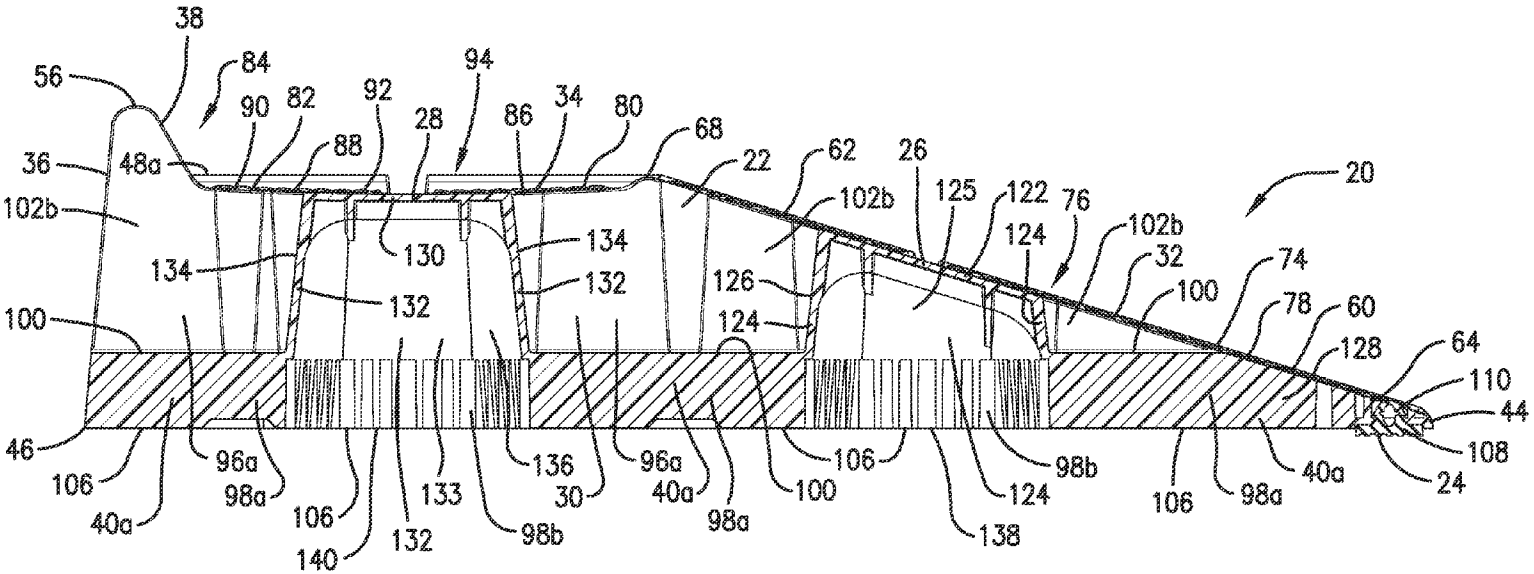
FIG. 4 is a cross-sectional view of the vehicle ramp taken along line 4-4 in FIG. 3.
Figure 4A:
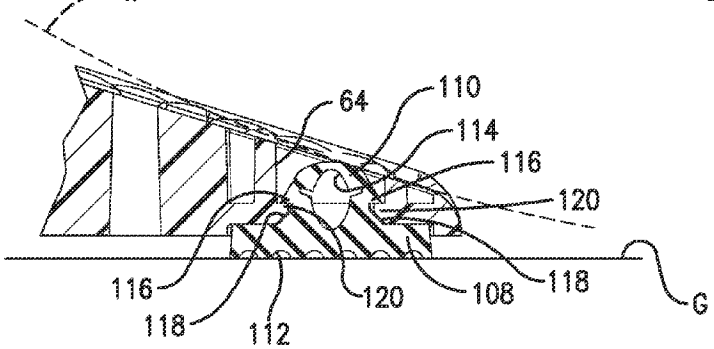
Figure 5:
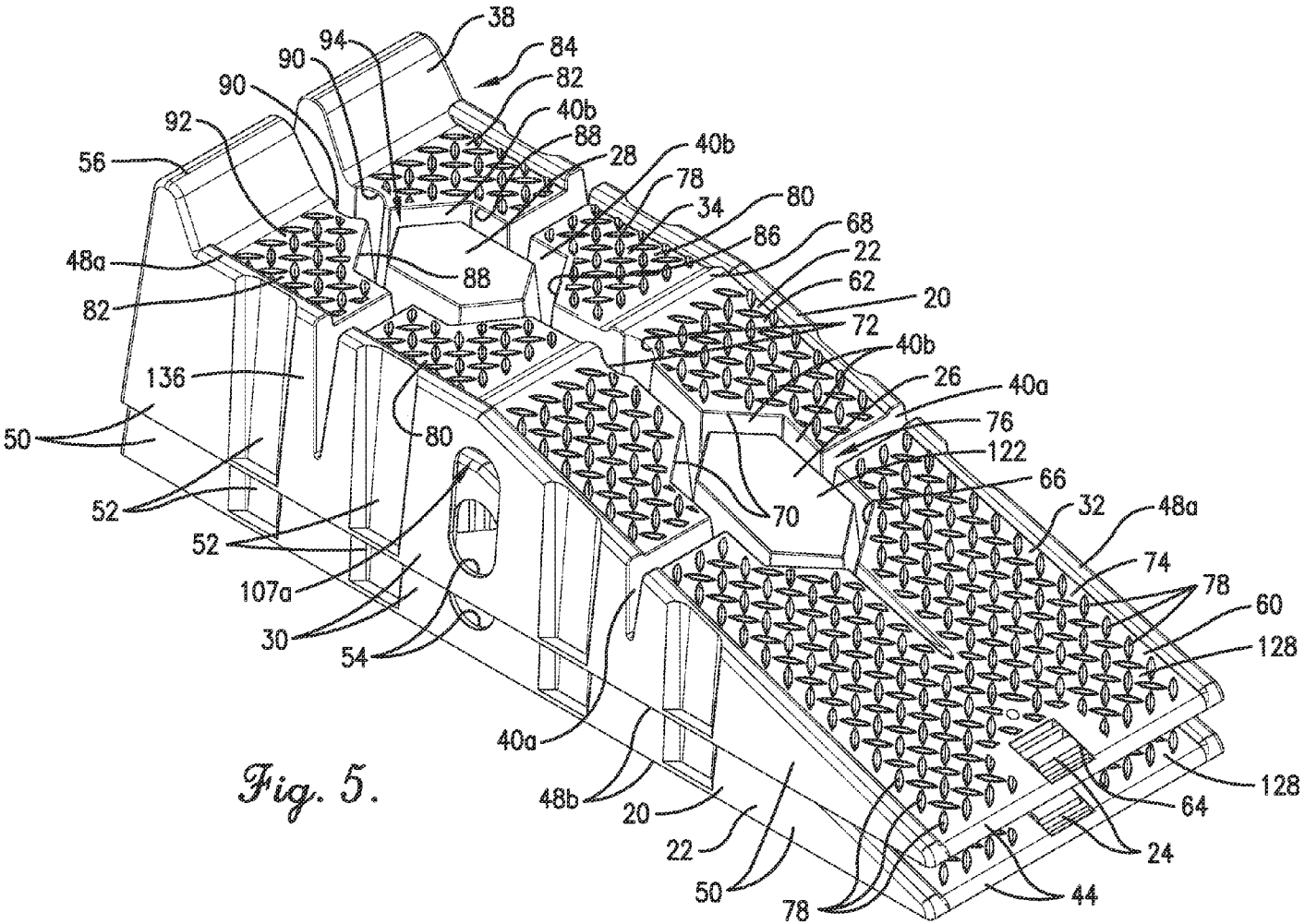
Figure 6:
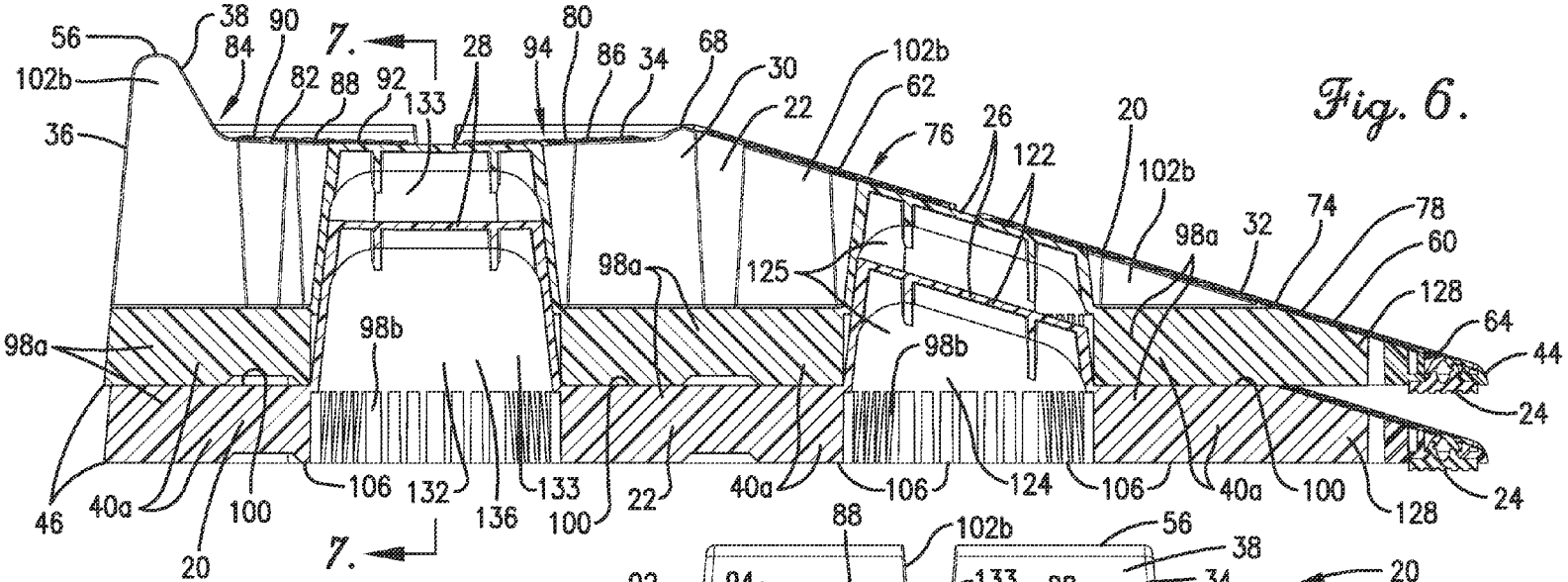
Figure 7:
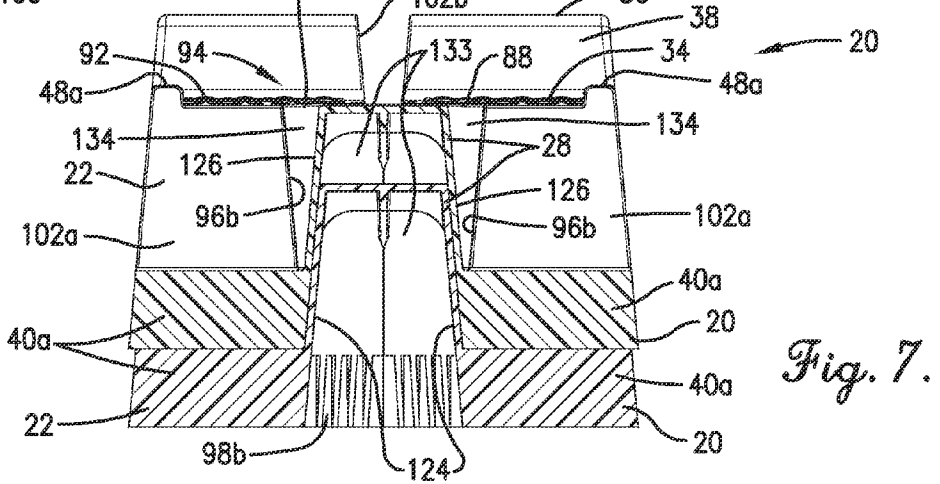
Figure 8:
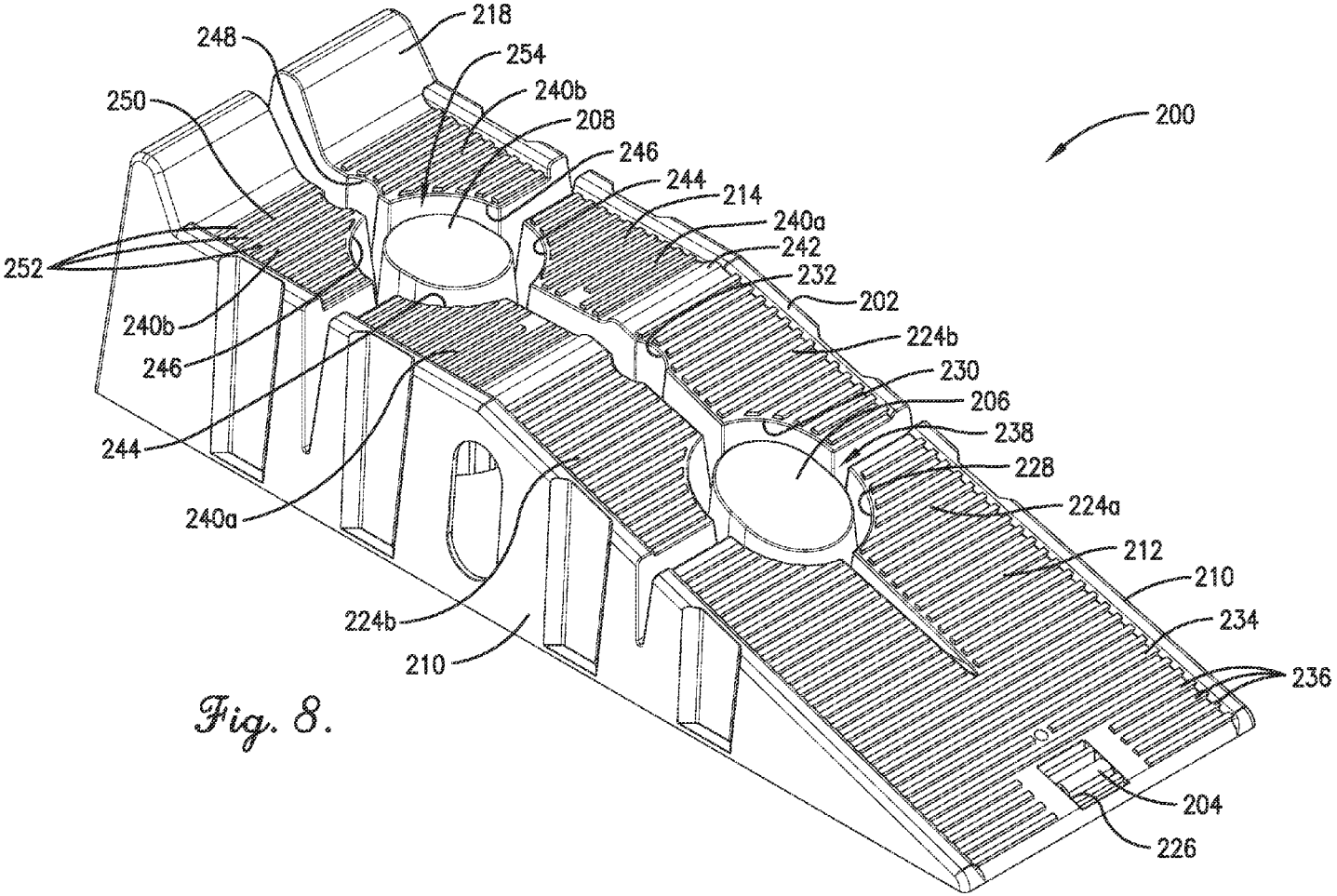
Figure 9:
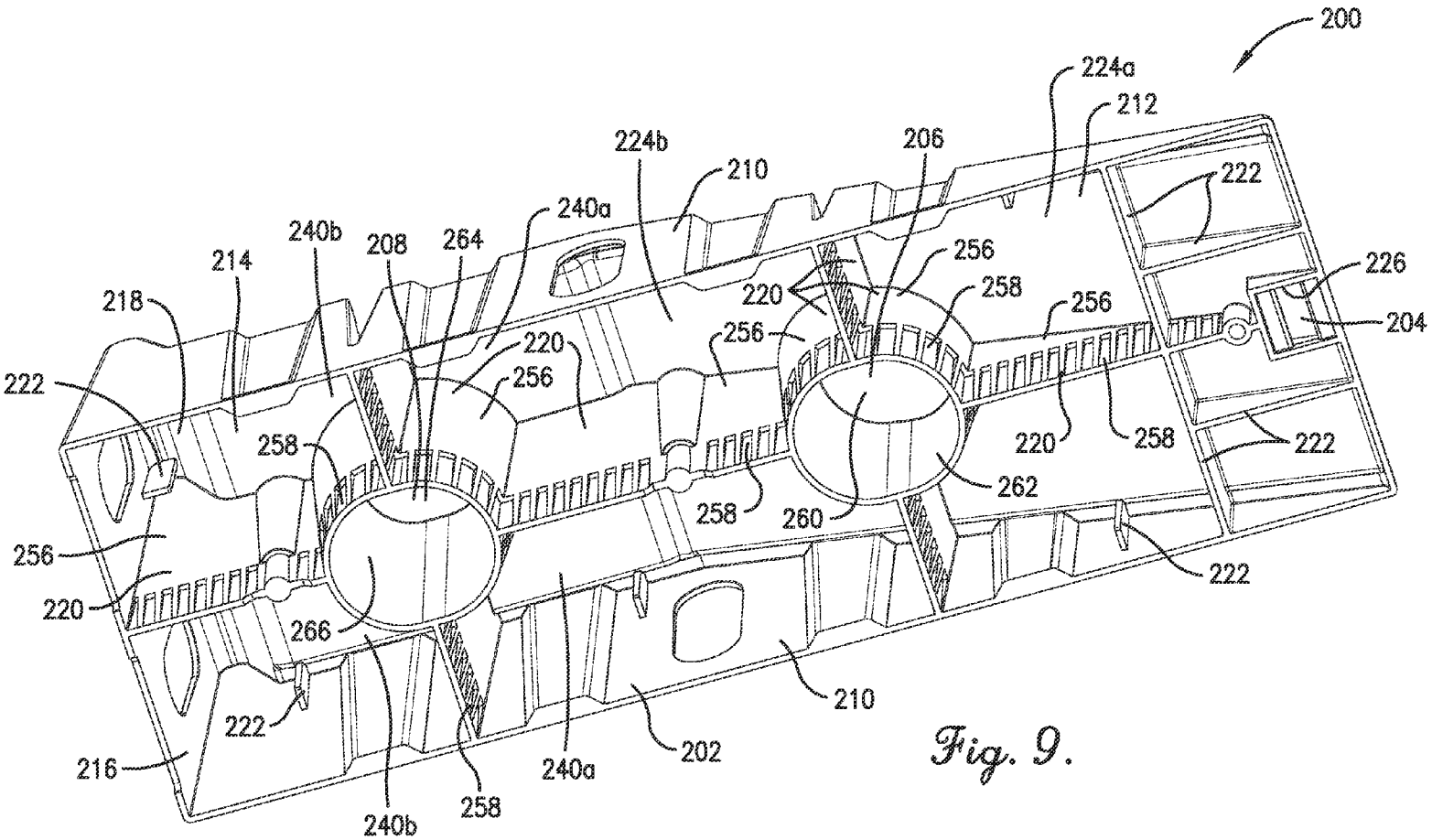
Figure 10:
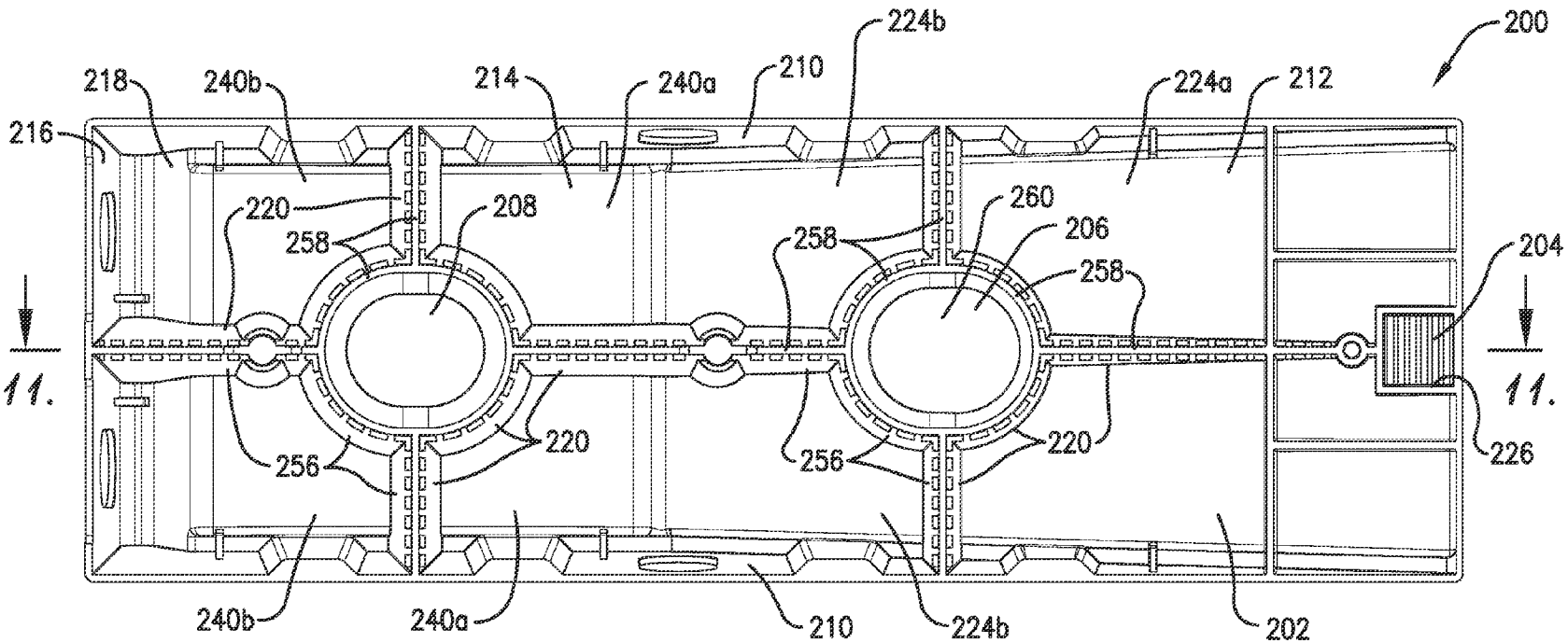
Figure 11:
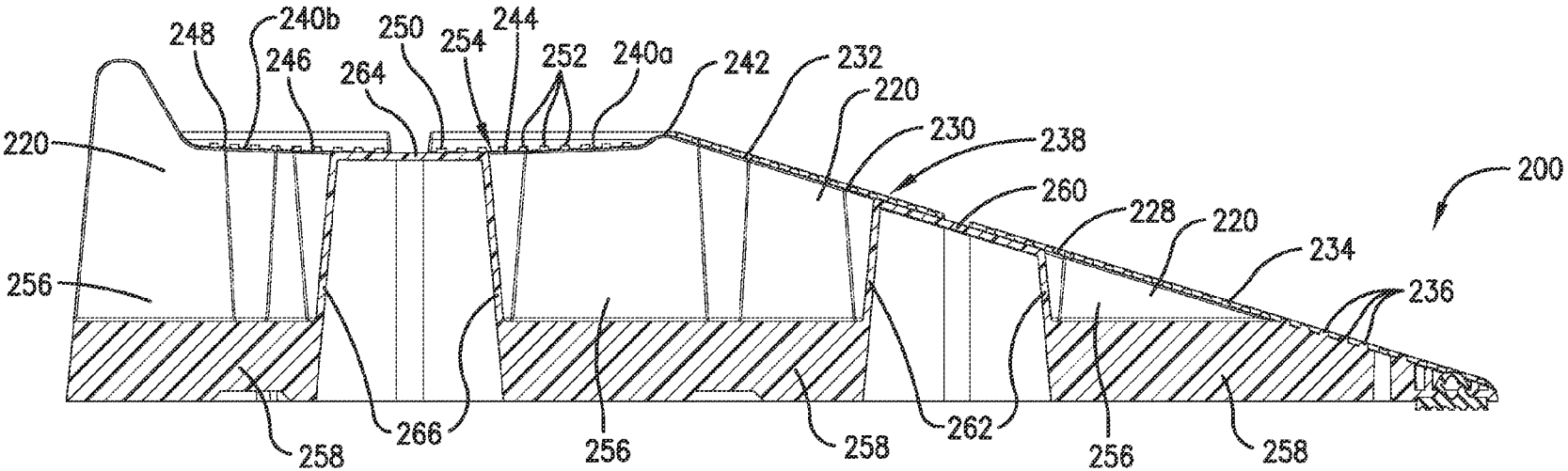
Figure 12:
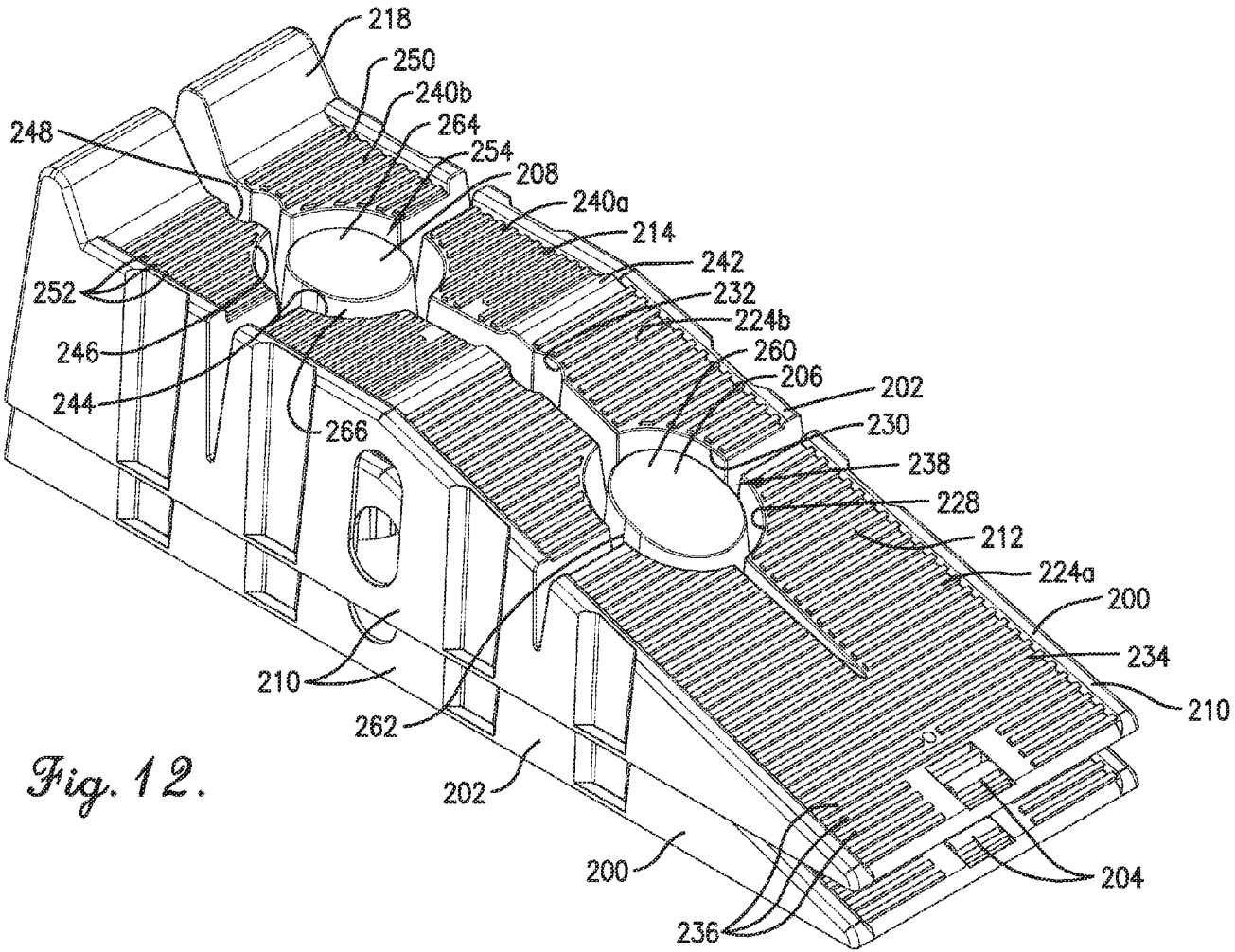
Figure 13:
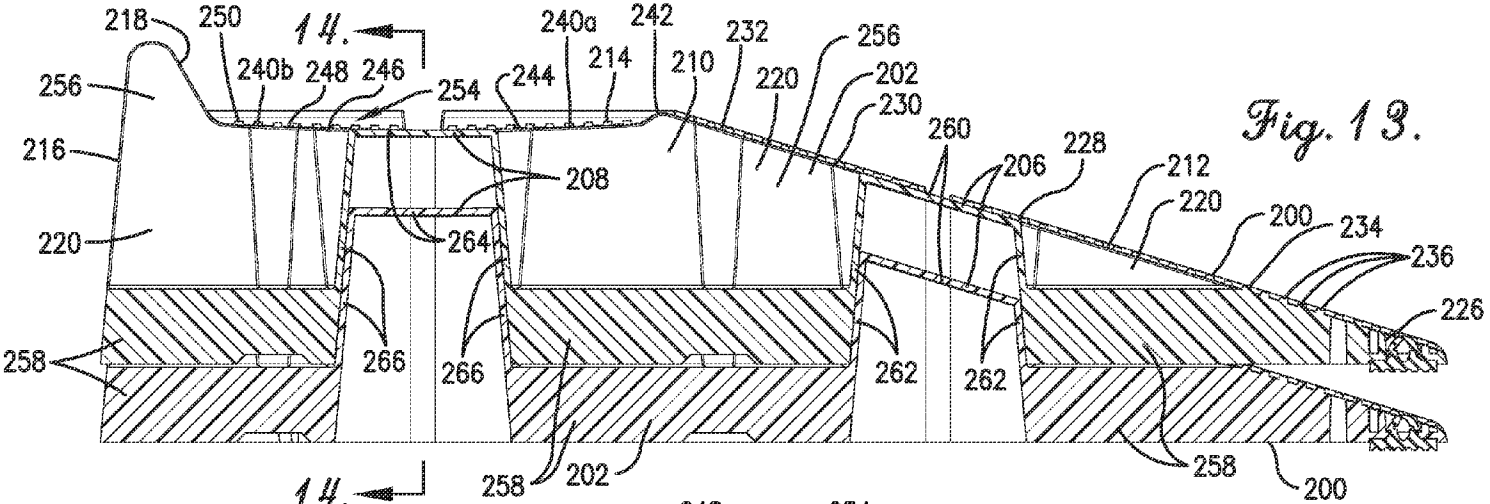
Figure 14:
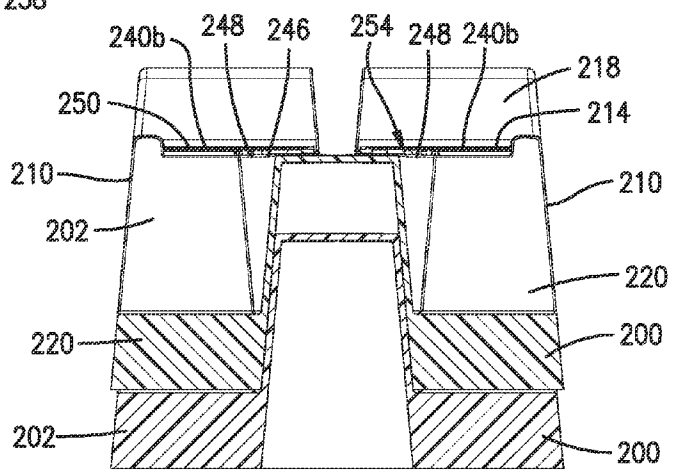

FIG. 4*a* is a fragmentary cross-sectional view of the vehicle ramp similar to FIG. 4, but showing a portion of the vehicle ramp adjacent a ramp leading edge;

FIG. 5 is an upper perspective of a pair of the vehicle ramps shown in FIGS. 1-4*a*, showing a lower one of the ramps positioned partly within an upper one of the ramps so that the ramps are nested with one another;

FIG. 6 is a cross-sectional view of the nested vehicle ramps shown in FIG. 5;

FIG. 7 is a cross-sectional view of the nested vehicle ramps taken along line 7-7 in FIG. 6;

FIG. 8 is an upper perspective of a vehicle ramp constructed in accordance with a second embodiment of the present invention, with the vehicle ramp including a body, a pair of columns formed with the body, and a foot mounted adjacent a leading edge of the body, and showing side walls, a stop wall, a platform wall, and a ramp wall of the body;

FIG. 9 is a lower perspective of the vehicle ramp shown in FIG. 8, showing an inner chamber defined by the body and an open face that communicates with the inner chamber, with the vehicle ramp further including interior walls and interior ribs located in the chamber;

FIG. 10 is a bottom view of the vehicle ramp shown in FIGS. 8 and 9;

FIG. 11 is a cross-sectional view of the vehicle ramp taken along line 11-11 in FIG. 10;

FIG. 12 is an upper perspective of a pair of the vehicle ramps shown in FIGS. 8-11, showing a lower one of the ramps positioned partly within an upper one of the ramps so that the ramps are nested with one another;

FIG. 13 is a cross-sectional view of the nested vehicle ramps shown in FIG. 12; and FIG. 14 is a cross-sectional view of the nested vehicle ramps taken along line 14-14 in FIG. 13.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
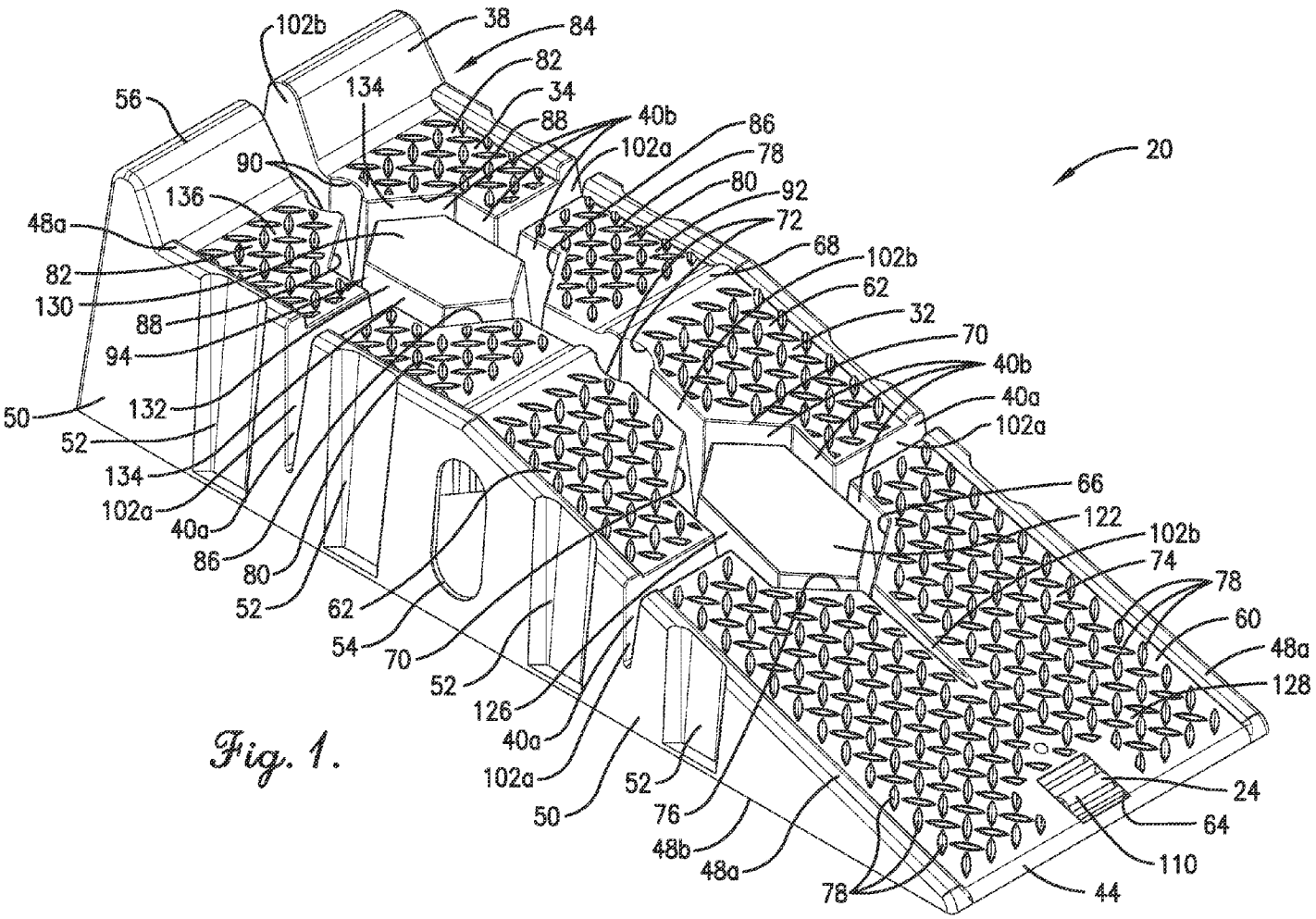
FIG. 1 is an upper perspective of a vehicle ramp constructed in accordance with a first embodiment of the present invention, with the vehicle ramp including a body, a pair of columns formed with the body, and a foot mounted adjacent a leading edge of the body, and showing side walls, a stop wall, a platform wall, and a ramp wall of the body.

Turning initially to FIGS. 1 and 5, one of a pair of identical vehicle ramps 20 is shown constructed in accordance with an embodiment of the present invention. As will be described, the vehicle ramp 20 is used to support a vehicle wheel W in an elevated supported position spaced above ground G (see FIG. 4*a*). In the usual manner, the vehicle ramp 20 serves to elevate a vehicle, such as an automobile, into the supported position. The vehicle can be elevated for various purposes, such as vehicle maintenance. In particular, the ramp 20 is constructed with inclined portions such that the wheel W can be rolled between the supported position and a position where the wheel W is directly on ground G. As will be discussed, multiple vehicle ramps 20 can be nested with one another for easy transportation and storage. The illustrated vehicle ramp 20 preferably includes a ramp body 22, a foot 24, and ramp and platform columns 26,28.

Turning to FIGS. 1-4*a*, an embodiment of the ramp body 22 comprises a unitary, elongated structure operable to provide load-bearing support of the wheel W. However, for some aspects of the present invention, the ramp body 22 could include multiple interconnected body components. The illustrated ramp body 22 includes a pair of side walls 30, inclined ramp wall 32, platform wall 34, rear wall 36, stop wall 38, interior walls 40*a,b*, and interior ribs 42. The side walls 30 each extend substantially from a proximal leading edge 44 of the ramp body 22 to a distal trailing edge 46 of the ramp body 22. As will be discussed, the side walls 30 are integrally formed with other sections of the ramp body 22. Each side wall 30 presents upper and lower margins 48*a,b* that extend continuously along the length of the side wall 30, with the upper margin being formed by upper ridges of the side wall 30. Each side wall 30 also includes a substantially planar wall section 50 and spaced apart upright reinforcement sections 52 integrally formed therewith. Each side wall 30 also presents a centrally located and generally oval shaped opening 54.

The rear wall 36 is unitary and projects upwardly from a lower margin that forms the distal trailing edge 46 to an upper margin 56. The rear wall 36 also presents a pair of openings 58 located along side one another. The stop wall 38 projects downwardly and rearwardly from the upper margin 56. As will be discussed, the stop wall 38 serves to restrict distal wheel movement when the wheel W is on the platform wall 34.

An embodiment of the ramp wall 32 includes proximal and distal ramp wall sections 60,62. The proximal ramp wall section 60 extends distally from the leading edge 44 and presents a foot opening 64 and a distal opening 66. The distal ramp wall sections 62 are spaced distally from wall section 60 and extend to a laterally extending ridge 68. The wall sections 62 each present a proximal and distal openings 70,72. The wall sections 60,62 cooperatively form an upper ramp surface 74. Furthermore, the wall sections 60,62 cooperatively define an open face 76 to receive the ramp columns 26 in a position located between the openings 66,70. The wall sections 60,62 extend laterally to and are integrally formed with upper ridges of the respective side walls 30.

The illustrated upper ramp surface 74 includes corrugations 78. The illustrated corrugations 78 are in the form of a conventional diamond tread pattern. However, the corrugations 78 could take other forms, as will be shown in a subsequent embodiment. The wall sections 60,62 are shaped so that the upper ramp surface is generally planar. However, it is within the scope of the present invention for the upper ramp surface 74 to have an alternative form, such as one or more concave and/or convex shapes.

An embodiment of the platform wall 34 includes proximal and distal platform wall sections 80,82. The proximal wall sections 80 extend distally from the ridge 68. Distal wall sections 82 extend proximally from a lower margin 84 of the stop wall 38. The proximal platform wall sections 80 each present openings 86. The distal platform wall sections 82 each present proximal and distal openings 88,90, and extend to the lower margin 84 presented by the stop wall 38. The wall sections 80,82 cooperatively form an upper platform surface 92. Furthermore, the wall sections 80,82 cooperatively define an open face 94 to receive the platform column 28 in a position located between the openings 86,88. The ridge 68 is spaced apart from the stop wall 38 so that the ridge 68 and stop wall 38 cooperatively restrict rolling wheel movement when the wheel W is received on the platform. The wall sections 80,82 extend laterally to and are integrally formed with upper ridges of the respective side walls 30.

The illustrated upper platform surface 92 also includes corrugations 78. Again, the illustrated corrugations 78 are in the form of a conventional diamond tread pattern, but could take other forms. The wall sections 80,82 are shaped so that the upper platform surface 92 is slightly concave in a longitudinal direction (see FIG. 4). However, it is within the scope of the present invention for the upper platform surface 92 to have an alternative form, e.g., where the upper platform surface 92 is generally planar, convex, or has multiple concave and/or convex shapes. The illustrated ramp and platform surfaces cooperatively form a wheel-supporting upper body surface of the ramp body 22, with the upper body surface defining an upper body surface area.

Figure 2:
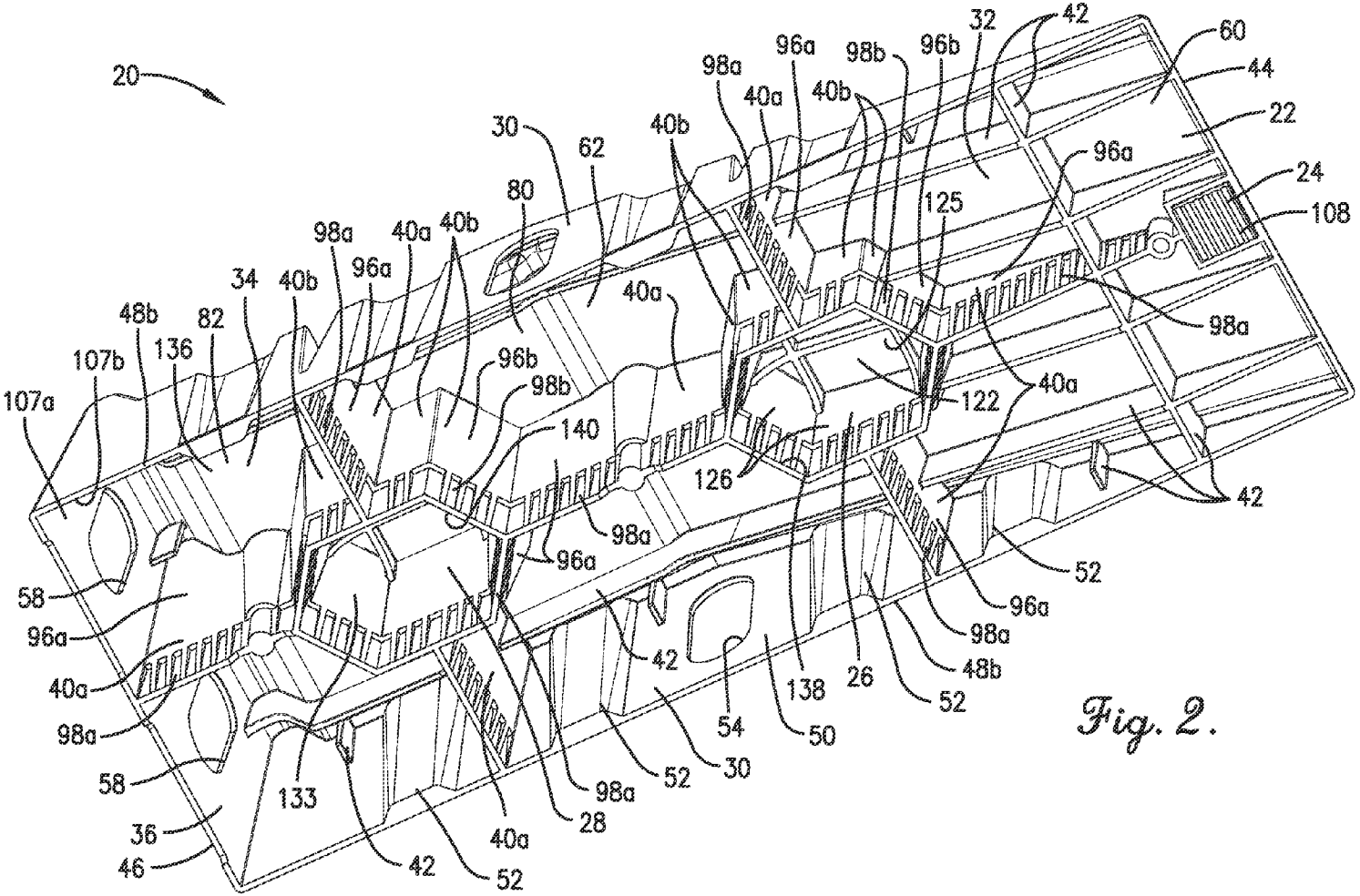
FIG. 2 is a lower perspective of the vehicle ramp shown in FIG. 1, showing an inner chamber defined by the body and an open face that communicates with the inner chamber, with the vehicle ramp further including interior walls and interior ribs located in the chamber.

Turning to FIGS. 2-4, the interior walls 40 include groove wall sections 96*a,b* and base wall sections 98*a,b*. The groove wall sections 96 extend continuously from respective sections of the ramp and platform walls 32,34 to a lower groove margin 100 (see FIG. 4).

The groove wall sections 96*a* meet to form a generally V-shaped cross section. Furthermore, the groove wall sections 96*a* preferably define lateral and longitudinal grooves 102*a,b* that preferably have a generally downwardly tapering triangular cross sectional shape (see FIGS. 1, 6, and 7). However, the principles of the present invention are applicable where the groove wall sections 96 present an alternative cross sectional shape. For instance, the grooves 102 could have an alternative downwardly tapering cross sectional shape, such as a trapezoidal shape, to permit ramp nesting. As will be discussed, the groove wall sections 96*b* extend downwardly to the lower groove margin 100 so that the groove wall sections 96*b* meet with groove wall sections of the columns 26,28.

In the illustrated embodiment, the lateral grooves 102*a* intersect respective side walls 30. However, for some aspects of the present invention, the lateral grooves 102*a* could have an alternative configuration. Furthermore, the vehicle ramp 20 could be devoid of one or more lateral grooves 102*a*. The illustrated lateral grooves 102*a* also intersect respective upper ramp and platform surfaces 74,92 to define respective open groove faces. Each open groove face of the lateral grooves 102*a* presents an area that is greater than that of the associated lower wall margin 106.

The longitudinal grooves 102*b* extend generally along the longitudinal axis of the vehicle ramp 20. The illustrated grooves 102 intersect corresponding grooves that surround the columns 26,28. Also, the distal-most longitudinal groove 102*b* preferably intersects the rear wall 36. However, for some aspects of the present invention, the longitudinal grooves 102*b* could have an alternative configuration. Yet further, the vehicle ramp 20 could be devoid of one or more of the longitudinal grooves 102*b*. The longitudinal grooves 102*b* also intersect respective upper ramp and platform surfaces 74,92 to define respective open groove faces. Each open groove face of the lateral grooves 102*a* presents an area that is greater than that of the associated lower wall margin 106.

The base wall sections 98 each include a continuous wall in a plurality of spaced apart upright ridges 104 integral thereto (see FIG. 3). The base wall sections 98 extend from the lower groove margin 100 of the groove wall sections 96 to a lower wall margin 106 (see FIGS. 4 and 6). While the interior walls 40 include groove wall sections 96 and base wall sections 98 that generally form a Y-shaped cross section, is also within the scope of the present invention for the interior walls 40 to have an alternative shape. For instance, the interior walls could be devoid of base wall sections 98 so that the groove wall sections 96 meet immediately adjacent the lower wall margin 106.

The lower margins 48*b* of side walls 30, leading and trailing edges 44,46, and lower wall margins 106 cooperatively form a ground-engaging lower surface of the ramp body 22 (see FIG. 4). However, the body 22 could be alternatively configured to present the ground-engaging lower surface without departing from the scope of the present invention.

An embodiment of the interior ribs 42 include longitudinal ribs 42*a*, lateral rib 42*b*, and gussets 42*c*. The longitudinal ribs 42*a* extend continuously between the leading and trailing edges 44,46 and are preferably integrally formed with the ramp and platform walls 32,34. The lateral rib 42*b* is spaced distally from and extends generally parallel to the leading edge 44. The lateral rib 42*b* and gussets 42*c* are also preferably integrally formed with respective ramp and platform walls 32,34.

The illustrated side walls 30, ramp wall 32, platform wall 34, rear wall 36, and stop wall 38 cooperatively define a body inner chamber 107*a*, which receives the interior walls and ribs 40,42 (see FIG. 2). The side walls 30, ramp wall 32, and rear wall 36 also define an open face 107*b* of the ramp body 22 that extends along the lower margins 48*a*,*b* and leading and trailing edges 44,46 and communicates with the inner chamber 107*a*. As will be discussed, the ramp body 22 preferably presents the chamber 107*a* and open face 107*b* so that a pair of vehicle ramps 20 can be nested with one another. Also, the open face 107*b* defines a face area that is greater than the upper body surface area so that the upper surfaces 74,92 of one vehicle ramp 20 can be received through the open face 107*b* and partly within the inner chamber 107*a* of another vehicle ramp 20 when the ramps 20 are nested with one another (see FIGS. 6 and 7).

The foot 24 is preferably unitary and includes a base 108 and a retainer 110 integrally formed with one another. The base 108 presents a corrugated bottom surface 112 operable to engage ground G (see FIG. 4*a*). The retainer 110 presents a lateral opening 114 with lateral slots so that the retainer 110 is flexible relative to the base 108. The retainer 110 also presents a pair of tabs 116, with the tabs 116 and base 108 cooperatively forming lateral grooves 118. The foot includes a resilient elastomer material. The foot 24 is secured in the opening 64 by inserting the retainer 110 upwardly through the bottom of opening 64 until projections 120 are received and retained in corresponding grooves 118. In a relaxed position, the retainer 110 projects above the ramp surface 74. When the wheel W rolls onto the foot 24, the wheel W compresses the retainer 110 so that the wheel W applies pressure directly to the base 108 (see FIG. 4*a*).

The illustrated columns 26,28 cooperate with the ramp body 22 to support the wheel W. Preferably, the ramp column 26 includes a ramp wall section 122 and integrally formed grooved wall sections 124 that cooperatively define a hollow center 125 (see FIGS. 2 and 4). The illustrated ramp wall section 122 has a hexagonal shape, with groove wall sections 124 projecting downwardly from respective edges of the ramp wall section 122.

The groove wall sections 124 extend downwardly to meet with respective groove wall sections 96*b* of the ramp body 22 to form a generally V-shaped cross section. Furthermore, the groove wall sections 124,96*b* define grooves 126 that have a generally downwardly tapering triangular cross sectional shape. However, the principles of the present invention are also applicable where the groove wall sections 124,96*b* could have an alternative downwardly tapering cross sectional shape, such as a trapezoidal shape to prevent ramp nesting. Thus, the ramp column 26 and ramp body 22 cooperatively form an inclined ramp section 128 of the vehicle ramp 20.

An embodiment of the platform column 28 includes a platform wall section 130 and integrally formed grooved wall sections 132 that cooperatively define a hollow center 133. The illustrated platform wall section 130 also has a hexagonal shape, with groove wall sections 132 projecting downwardly from respective edges of the platform wall section 130. However as will be shown in a subsequent embodiment, the principles of the present invention are applicable where the ramp and platform walls 122,130 have an alternative shape.

The groove wall sections 132 extend downwardly to meet with respective groove wall sections 96*b* of the ramp body 22 to form a generally V-shaped cross section. Furthermore, the groove wall sections 132 define grooves 134 that have a generally downwardly tapering triangular cross section shape. However it is also within the scope of the present invention for the groove wall sections 132,96*b* to present an alternative cross sectional shape. For instance, the grooves 134 could have an alternative downwardly tapering cross sectional shape, such as a trapezoidal shape, to permit ramp nesting. Thus, the platform column 28 and body 22 cooperatively form a platform section 136 of the vehicle ramp 20.

The illustrated ramp and platform walls 122,130 cooperate with the upper body surface to form an upper ramp surface to support the wheel W. The illustrated columns 26,28 are preferably substantially surrounded by the ramp body 22, although the columns and body could be alternatively configured without departing from the scope of the present invention.

The illustrated grooves 126,134 intersect the upper body surface of the ramp body 22 to define respective open groove faces. Each open groove face preferably presents an area that is greater than that of the associated lower wall margin 106. Furthermore, the grooves 126,134 extend endlessly about the respective columns 26,28 to surround and isolate each column from the ramp body 22 along the upper body surface.

The hollow centers 125,133 communicate with respective open column faces 138,140 (see FIGS. 2 and 4) so that a pair of vehicle ramps 20 can be nested with one another. Also, the open column faces 138,140 each define a face area that is greater than the area of the respective wall sections 122,130. Thus, the wall sections 122,130 of one vehicle ramp 20 can be received through the respective open column faces 138,140 and within the respective hollow centers 125,133 of another vehicle ramp 20 when the ramps 20 are nested with one another (see FIGS. 6 and 7).

Turning to FIGS. 5-7, a pair of the vehicle ramps 20 may be used to elevate respective wheels of a vehicle for various purposes, such as vehicle maintenance, in a supported position. In the usual manner, the vehicle ramps 20 are initially positioned in front of the respective wheels, with each leading edge 44 being immediately adjacent the respective wheel. The wheels of the vehicle are moved onto the vehicle ramp 20 in the supported position by rolling the wheels forwardly into engagement with the leading edge 44 and foot 24. This engagement secures each of the vehicle ramps 20 in engagement with the ground G.

Additional forward movement of the vehicle causes the wheels to roll up the ramps section 128 and into engagement with the ramp wall 32. Continued forward movement of the vehicle causes the wheels to roll over the ridge 68 and onto the platform section 136. The wheels then roll into engagement with the stop wall 38 and the platform wall 34. Thus, the stop wall 38 and ridge 68 cooperatively restrict rolling wheel movement when the wheel is received on the platform section 136.

Similarly, the wheels can be removed from the supported position by rolling the wheels in a generally rearward direction. Initially, the wheels are rolled from the platform section 136 to the ramp section 128 by rolling over the ridge 68. The wheels are then rolled out of engagement with the vehicle ramps 20 by rolling the wheels over the leading edge 44.

Turning to FIGS. 5-7, the pair of vehicle ramps 20 can be selectively positioned in a nested condition, e.g., for compactly storing the vehicle ramps 20. Again, the ramp body 22 presents the chamber 107*a* and open face 107*b* so that the vehicle ramps 20 can be nested with one another. The open face 107*b* defines a face area that is greater than the upper body surface area so that the upper surfaces 74,92 of one vehicle ramp 20 can be received through the open face 107*b* and partly within the inner chamber 107*a* of another vehicle ramp 20 when the ramps 20 are nested with one another.

Again, the hollow centers 125,133 communicate with respective open column faces 138,140 (see FIGS. 2 and 4) so that a pair of vehicle ramps 20 can be nested with one another. Also, the open column faces 138,140 each define a face area that is greater than the area of the respective wall sections 122,130. Thus, the wall sections 122,130 of one vehicle ramp 20 can be received through the respective open column faces 138,140 and within the respective hollow centers 125,133 of another vehicle ramp 20 when the ramps 20 are nested with one another (see FIGS. 6 and 7).

Also, when the illustrated ramps 20 are nested with one another, lower wall margins 106 are at least partly received in the associated groove 102,126,134. More preferably, when the ramps 20 are nested, the lower wall margins 106 presented by base wall sections 98 of one vehicle ramp 20 engage a corresponding base wall section 98 of the other vehicle ramp 20 (see FIGS. 6 and 7). In this manner, the base wall sections 98 serve as stops that restrict further insertion of one ramp into the open face of the other ramp.

Turning to FIGS. 8-14 an alternative vehicle ramp 200 constructed in accordance with a second embodiment of the present invention is shown. For the sake of brevity, the remaining description will focus primarily on the differences of this alternative embodiment compared to the previous embodiment.

The illustrated vehicle ramp 200 includes a ramp body 202, foot 204, and ramp and platform columns 206,208. The ramp body 202 includes a pair of side walls 210 an alternative ramp wall 212, an alternative platform wall 214, a rear wall 216, a stop wall 218, alternative interior walls 220, and alternative interior ribs 222.

The ramp wall 212 includes alternative ramp wall sections 224*a,b*. The wall section 224*a* extends distally from the leading edge of the ramp 200 and presents a foot opening 226 and a distal opening 228. The wall sections 224*b* each represent proximal and distal openings 230,232. The wall sections 224 cooperatively form an upper ramp surface 234 with lateral corrugation 236. Furthermore, the wall sections 224 cooperatively define an open face 238 to receive the ramp column 206 in a position located between the openings 228,230.

The platform wall 214 includes proximal and distal platform wall sections 240*a,b*. Proximal wall sections 240*a* extend distally from ridge 242, and distal wall sections 240*b* extend proximally from the stop wall 218. The proximal wall sections 240*a* each present openings 244. The distal wall sections 240*b* each present proximal and distal openings 246, 248. The wall sections 240*a,b* cooperatively form an upper platform surface 250 with lateral corrugations 252. Furthermore, the wall sections 240*a,b* cooperatively define an open face 254 to receive the platform column 208 in a position located between the openings 244,246. The ridge 242 is spaced apart from the stop wall 218 so that the ridge 242 and stop wall 218 cooperatively restrict rolling wheel movement when the wheel is received on the platform.

The interior walls 220 include groove wall sections 256 and base wall sections 258. The groove wall sections 256 extend continuously from respective sections of the ramp and platform walls 212,214 to lower groove margin. The illustrated groove wall sections 256 have a generally curved shape so that the wall sections extend corresponding columns 206, 208.

The illustrated columns 206,208 cooperate with the ramp body 202 to support the wheel. The ramp column 206 includes a ramp wall section 260 and integrally formed groove wall sections 262. The illustrated ramp wall section 260 has a generally oval-shape, with groove wall sections projecting downwardly from respective edges of the ramp wall section 260.

The platform column 208 includes a platform wall section 264 and integrally formed groove wall sections 266. The illustrated platform wall section 264 also has an oval-shape, with groove wall sections 266 projecting downwardly from respective edges of the platform wall section 264.

The forms of the invention described above are not to be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A vehicle ramp to engage and support a wheel in an elevated position spaced above the ground, said vehicle ramp comprising:

an elongated body forming at least part of a platform section to support the wheel in the elevated position and at least part of an inclined ramp section to permit the wheel to be rolled between the elevated position and a position on a ground surface, said platform and inclined ramp sections cooperatively presenting a ground-engaging lower surface and a wheel-supporting upper surface; and an upright column substantially surrounded by the platform section, said column presenting respective parts of the upper surface and extending downwardly from the upper surface to the ground-engaging lower surface, with the column not extending above the upper surface along the platform section, said column being defined along the upper surface by an endless surrounding groove that intersects the upper surface and extends endlessly about the column so that the column is isolated from the body along the upper surface.

2. The vehicle ramp as claimed in claim 1, said body presenting a rear surface, said body presenting a longitudinal groove that intersects the upper surface, the rear surface, and the surrounding groove and extends longitudinally therebetween.

3. The vehicle ramp as claimed in claim 2, said body presenting opposite side surfaces, said body presenting a lateral groove that intersects the upper surface, the side surfaces, and the surrounding groove.

4. The vehicle ramp as claimed in claim 3, said body including groove walls that cooperatively define the grooves, with the grooves being defined by opposite pairs of groove walls.

5. The vehicle ramp as claimed in claim 4, each of said opposite pairs of groove walls having walls that extend downwardly from the upper surface and converge so as to be joined along a lower margin.

6. The vehicle ramp as claimed in claim 5, each of said opposite pairs of groove walls presenting a generally V-shaped cross-sectional profile.

7. The vehicle ramp as claimed in claim 5, said lower margins being spaced above the lower surface, said body including base walls that are joined with respective groove walls along the associated lower margins, with the base walls extending downwardly to present part of the lower surface.

8. The vehicle ramp as claimed in claim 7, each of said opposite pairs of groove walls and associated base walls presenting a generally Y-shaped cross-sectional profile.

9. The vehicle ramp as claimed in claim 1, said column being part of the platform section.

10. The vehicle ramp as claimed in claim 9, an upright second column substantially surrounded by the body and being part of the inclined ramp section, said second column being defined along the upper surface by a second surrounding groove that intersects the upper surface and extends endlessly about the second column so that the second column is isolated from the body along the upper surface.

11. The vehicle ramp as claimed in claim 1, said body presenting a leading edge; and a resilient foot attached to the body adjacent the leading edge, said foot presenting top and bottom foot surfaces, said top foot surface being exposed and positioned adjacent the upper surface, said bottom foot surface being exposed and positioned adjacent the lower surface so that wheel contact with the top foot surface urges the bottom foot surface into ground engagement.

12. A vehicle ramp to engage and support a wheel in an elevated position spaced above the ground, said vehicle ramp comprising:

an elongated body forming at least part of a platform section to support the wheel in the elevated position and at least part of an inclined ramp section to permit the wheel to be rolled between the elevated position and a position on a ground surface, said platform and inclined ramp sections cooperatively presenting a ground-engaging lower surface and a wheel-supporting upper surface;

an upright column substantially surrounded by the body, said column presenting respective parts of the upper surface and extending downwardly therefrom, said column being defined along the upper surface by a surrounding groove that intersects the upper surface and extends about the column so that the column is isolated from the body along the upper surface, said column being part of the platform section; and an upright second column substantially surrounded by the body and being part of the inclined ramp section, said second column being defined along the upper surface by a second surrounding groove that intersects the upper surface and extends endlessly about the second column so that the second column is isolated from the body along the upper surface, said body presenting an intermediate groove that intersects the upper surface and the first and second surrounding grooves and extends longitudinally therebetween.

13. The vehicle ramp as claimed in claim 12, said platform section presenting a rear surface, said platform section presenting a longitudinal groove that intersects the upper surface, the rear surface, and the surrounding groove and extends longitudinally therebetween.

14. The vehicle ramp as claimed in claim 13, said body presenting opposite side surfaces, said body presenting a first lateral groove that intersects the upper surface, the side surfaces, and the first mentioned surrounding groove, said body presenting a second lateral groove that intersects the upper surface, the side surfaces, and the second surrounding groove.

15. A pair of nestable vehicle ramps to support a wheel in an elevated position spaced above a ground surface, each of said nestable vehicle ramps comprising:

a body forming at least part of a platform section to support the wheel in the elevated position, with the body being operable to permit the wheel to be rolled between the elevated position and a position on the ground surface, said body including upright side walls and an upper wall that interconnects and extends between the side walls, said upper wall presenting a wheel-supporting upper surface that defines an upper surface area, said body defining an inner chamber between said walls and an open face communicating with the inner chamber, said open face defining a face area that is greater than the upper surface area so that the upper surface of one of the vehicle ramps can be received through the open face and at least partly within the inner chamber of the other of the vehicle ramps; and an upright column substantially surrounded by the platform section, said column presenting part of the upper surface and projecting downwardly from the upper surface to the ground-engaging lower surface, with the column not extending above the upper surface along the platform section, said column defining a hollow center spaced below the upper surface, with the column of one ramp received in the hollow center of the other ramp when the one ramp is received through the open face of the other ramp, said column being defined along the upper surface by an endless surrounding groove that intersects the upper surface and extends endlessly about the column so that the column is isolated from the body along the upper surface.

16. The vehicle ramps as claimed in claim 15, said body presenting a rear surface, said body presenting a longitudinal groove that intersects the upper surface, the rear surface, and the surrounding groove and extends longitudinally therebetween.

17. The vehicle ramps as claimed in claim 16, said body presenting opposite side surfaces, said body presenting a lateral groove that intersects the upper surface, the side surfaces, and the surrounding groove.

18. The vehicle ramps as claimed in claim 17, said body including groove walls that cooperatively define the grooves, with the grooves being defined by opposite pairs of groove walls.

19. The vehicle ramps as claimed in claim 18, each of said opposite pairs of groove walls having walls that extend downwardly from the upper surface and converge so as to be joined along a lower margin.

20. The vehicle ramps as claimed in claim 19, each of said opposite pairs of groove walls presenting an open groove face along the upper surface, each of said open groove faces presenting an area that is greater than that of the associated lower margin, with at least one of the lower margins of the other ramp received in the associated groove of the one ramp when the one ramp is received through the open face of the other ramp.

21. The vehicle ramps as claimed in claim 19, each of said opposite pairs of groove walls presenting a generally V-shaped cross-sectional profile.

22. The vehicle ramps as claimed in claim 19, said body presenting a ground-engaging lower surface, said lower margins being spaced above the lower surface, said body including base walls that are joined with respective groove walls along the associated lower margins, with the base walls extending downwardly to present part of the lower surface.

23. The vehicle ramps as claimed in claim 22, each of said opposite pairs of groove walls and associated base walls presenting a generally Y-shaped cross-sectional profile.

24. The vehicle ramps as claimed in claim 22, at least one of said base walls of the one ramp engaging a corresponding base wall of the other ramp when the one ramp is received through the open face of the other ramp so that the engaged base walls comprise stops that restrict further insertion of the one ramp through the open face of the other ramp.

25. The vehicle ramps as claimed in claim 15, said elongated body forming at least part of an inclined ramp section to permit the wheel to be rolled between the elevated position and a position on the ground.

26. The vehicle ramps as claimed in claim 25, said column being part of the platform section.

27. The vehicle ramps as claimed in claim 26, an upright second column substantially surrounded by the body and being part of the inclined ramp section, said second column being defined along the upper surface by a second surrounding groove that intersects the upper surface and extends endlessly about the second column so that the second column is isolated from the body along the upper surface.

28. The vehicle ramps as claimed in claim 15, said body presenting a leading edge; and a resilient foot attached to the body adjacent the leading edge, said foot presenting top and bottom foot surfaces, said top foot surface being exposed and positioned adjacent the upper surface, said bottom foot surface being exposed and positioned adjacent the lower surface so that wheel contact with the top foot surface urges the bottom foot surface into ground engagement.

29. A pair of nestable vehicle ramps to support a wheel in an elevated position spaced above a ground surface, each of said nestable vehicle ramps comprising:

a body operable to support the wheel in the elevated position and to permit the wheel to be rolled between the elevated position and a position on the ground surface, said body including upright side walls and an upper wall that interconnects and extends between the side walls, said upper wall presenting a wheel-supporting upper surface that defines an upper surface area, said body defining an inner chamber between said walls and an open face communicating with the inner chamber, said open face defining a face area that is greater than the upper surface area so that the upper surface of one of the vehicle ramps can be received through the open face and at least partly within the inner chamber of the other of the vehicle ramps;

an upright column substantially surrounded by the body, said column presenting part of the upper surface and projecting downwardly from the upper surface to define a hollow center spaced below the upper surface, with the column of one ramp received in the hollow center of the other ramp when the one ramp is received through the open face of the other ramp, said column being defined along the upper surface by a groove that intersects the upper surface and extends about the column so that the column is isolated from the body along the upper surface, said elongated body forming at least part of a platform section to support the wheel in the elevated position and at least part of an inclined ramp section to permit the wheel to be rolled between the elevated position and a position on the ground, said column being part of the platform section; and an upright second column substantially surrounded by the body and being part of the inclined ramp section, said second column being defined along the upper surface by a second surrounding groove that intersects the upper surface and extends endlessly about the second column so that the second column is isolated from the body along the upper surface, said body presenting an intermediate groove that intersects the upper surface and the first and second surrounding grooves and extends longitudinally therebetween.

30. The vehicle ramps as claimed in claim 29, said platform section presenting a rear surface, said platform section presenting a longitudinal groove that intersects the upper surface, the rear surface, and the surrounding groove and extends longitudinally therebetween.

31. The vehicle ramps as claimed in claim 30, said body presenting opposite side surfaces, said body presenting a first lateral groove that intersects the upper surface, the side surfaces, and the first mentioned surrounding groove, said body presenting a second lateral groove that intersects the upper surface, the side surfaces, and the second surrounding groove.

* * * * *